US007611421B2

(12) United States Patent
Brewer et al.

(10) Patent No.: US 7,611,421 B2
(45) Date of Patent: Nov. 3, 2009

(54) GOLF CLUB HANDGRIP ELEVATION APPARATUS

(75) Inventors: Samuel Brewer, 1384 Dryden Rd., Ithaca, NY (US) 14850; Jeff Bugliari, Dryden, NY (US)

(73) Assignees: Samuel Brewer, Dryden, NY (US); Edward Kline, Hempstead, NY (US)

( * ) Notice: Subject to any disclaimer, the term of this patent is extended or adjusted under 35 U.S.C. 154(b) by 0 days.

(21) Appl. No.: 11/703,956

(22) Filed: Feb. 8, 2007

(65) Prior Publication Data

US 2008/0194351 A1 Aug. 14, 2008

(51) Int. Cl.
*A63B 55/10* (2006.01)

(52) U.S. Cl. ..... 473/282

(58) Field of Classification Search ..... 473/282, 473/256, 297, 286, 283–285, 295–296, 298–299, 473/223, 226, 276; 150/160
See application file for complete search history.

(56) References Cited

U.S. PATENT DOCUMENTS

| | | | | |
|---|---|---|---|---|
| 1,714,346 | A | 5/1929 | Carleton | |
| 2,801,875 | A * | 8/1957 | McEvoy | 294/19.2 |
| 4,040,631 | A | 8/1977 | Flippin | |
| 4,662,415 | A * | 5/1987 | Proutt | 150/160 |
| 4,821,358 | A * | 4/1989 | Wyckoff et al. | 15/104.92 |
| 4,838,285 | A | 6/1989 | Petrone | |
| 4,897,892 | A * | 2/1990 | Bubien | 15/88.2 |
| 4,934,066 | A * | 6/1990 | Rose | 34/333 |
| 4,946,510 | A * | 8/1990 | Kinnebrew et al. | 134/40 |
| 4,953,999 | A * | 9/1990 | Rivers | 401/9 |
| 4,991,839 | A | 2/1991 | Lumbattis, Jr. | |
| 5,076,581 | A | 12/1991 | Boberg | |
| 5,094,557 | A * | 3/1992 | Nelson et al. | 401/11 |
| 5,226,647 | A | 7/1993 | Notarmuzi | |
| 5,238,109 | A | 8/1993 | Smith | |
| 5,336,351 | A * | 8/1994 | Meyers | 156/158 |
| 5,575,720 | A | 11/1996 | Daniel | |
| 5,664,277 | A * | 9/1997 | Matlock | 15/160 |
| 5,701,998 | A * | 12/1997 | Perry et al. | 206/315.1 |
| 5,772,533 | A * | 6/1998 | Dahlmann | 473/386 |
| 6,029,315 | A * | 2/2000 | Flower | 16/422 |
| 6,196,930 | B1 * | 3/2001 | Aumock | 473/206 |
| 6,343,997 | B1 * | 2/2002 | Allen | 473/212 |
| 6,390,931 | B1 | 5/2002 | Berndt | |
| 6,482,103 | B1 | 11/2002 | Vache | |
| 6,638,177 | B1 * | 10/2003 | Wang | 473/286 |
| 6,685,372 | B1 * | 2/2004 | Foss et al. | 401/9 |

(Continued)

*Primary Examiner*—Stephen L. Blau
(74) *Attorney, Agent, or Firm*—Neal L. Slifkin

(57) ABSTRACT

A golf club handgrip elevation device is provided which maintains the handgrip of the golf club off of the ground when the club is placed on the ground. The invention includes an opening in a receiving section into which the club is placed and includes a gripping section for holding golf club end. The gripping section may include brushes, flexible ribs, or fingers. A contact section is provided to contact the ground after the handgrip has been placed into the receiving section. The contact section is wide enough, such that it does not damage the surface of the golf course. A grip section or grip ring is provided adjacent the contact section which does not touch the ground and allows the golfer to pick up the golf club and remove the device without touching the ground or the contact section. Thus, there is no transfer of moisture from the ground to the golfer's hand.

12 Claims, 10 Drawing Sheets

U.S. PATENT DOCUMENTS 6,964,618 B2 11/2005 Klein
2003/0096660 A1* 5/2003 Ward et al. ..... 473/299
2005/0233823 A1 10/2005 Klein
2005/0288122 A1 12/2005 Pare
2006/0058109 A1* 3/2006 Wilson, III ..... 473/286
2007/0099718 A1* 5/2007 McLaurin et al. ..... 473/286

* cited by examiner

GOLF CLUB HANDGRIP ELEVATION APPARATUS

FIELD OF THE INVENTION

The present invention relates to a device for elevating the handgrip of a golf club, such that it does not come in contact with the ground when the club is placed on the ground.

BACKGROUND OF THE INVENTION

In playing the game of golf, when a golf ball is near the green, a golfer will often take two or three clubs, including a putter, a chipping iron and, in some cases, a wedge out of the golf bag and walk towards the location of the golf ball. While one club is being used, the other club or clubs are typically placed on the ground.

When the club is placed on the ground, if the grass is wet due to rain, watering or dew, the handgrip of the club will become wet. The wet handgrip affects the golfer's ability to properly hold and use the club. In addition, the golf course maintenance crew may use herbicides and/or insecticides on the grass. When the handgrip is placed on the grass, a transfer of these undesirable chemicals to the handgrip and to the hand can occur.

Various patents teach of ways to elevate the handgrip off of the surface of the grass when the club is placed on the ground. However, these devices suffer from serious drawbacks, making them undesirable to use.

For example, U.S. Pat. No. 4,991,839 issued to Lumbattis, Jr. shows a device for supporting a golf club off the ground. This device consists of a flat disc or V-shaped support with an aperture to receive the handgrip portion of the golf club. A significant drawback of this device is that it has the potential for damaging the surface of the golf course. The weight of the club will push the legs or edge of the disc into the ground's surface, marking it. If the device is used on the green, damage to the green can occur, which is especially problematic.

A similar device is found in U.S. Pat. No. 5,076,581 issued to Boberg. In this device, a ring with a slot is placed over the handgrip to support the handgrip off of the ground. As with the Lumbattis device, the thin disc has the potential to damage the surface of the golf course. Furthermore, players will often place additional clubs on top of the elevated club, so that all clubs are elevated off of the ground. Because of the inclusion of a slot in the Boberg device, the club can be forced out of the slot, defeating the purpose of the device.

U.S. Patent Publication No. 2003/0096660 A1 discloses a sleeve which slides over the end of the golf club covering the handgrip. While this device keeps the handgrip from getting wet, the entire surface of the sleeve will become wet when it contacts the ground. As the golfer picks up the sleeve to remove it, the moisture from the sleeve is transferred to the golfer's hands, defeating the purpose of the product.

SUMMARY OF THE INVENTION

The present invention overcomes the deficiencies of the prior art. In particular, the present invention includes a golf club handgrip elevation device which maintains the handgrip of the golf club off of the ground in an advantageous manner. The invention includes a section for receiving the end of the handgrip into an opening. The opening includes a gripping section for holding the end of the golf club in place. The gripping section may include brushes, flexible ribs, flexible fingers, or other structures to secure and hold the end of the golf club within the opening.

A contact section is provided which is designed to contact the ground after the handgrip has been placed into the receiving section. The contact section, which may be in the form of a ring, is wide enough, such that it does not damage the surface of the golf course. If the contact section is too narrow, the weight of the golf club will force the contact section into the ground leaving a mark. This is particularly problematic if the mark is left on the putting green, which can interfere with proper putting. Preferably, the contact section has a width of at least 0.25 inches. The outside perimeter of the contact section should be substantially continuous, such that gaps are not present which can mark the surface of the ground.

A grip section is preferably located on the end of the contact section, opposite the handgrip. The grip section is smaller than the contact section as measured in the direction transverse to the longitudinal axis of the golf club. Thus, the grip section is maintained in a position off of the ground and remains dry even when the ground is wet.

Preferably, an optional grip shield can be used in combination with a handgrip elevation device to cover the entire grip if desired. For example, if it is raining, it may be desirable to cover the entire grip rather than just elevate grip off of the ground. In this case, the end of the grip shield is designed to fit inside the receiving section. The grip shield is preferably in the form of an elongated tube, but many other shapes are possible. In use, the end of the grip shield is installed into the receiving section of the elevation device and the combination is slid over the handgrip and attached as described above. The grip shield and elevation device are constructed, preferably, of polymer material.

It is possible to include, in the elevation device, an area upon which information can be printed. For example, at the end of the grip section, opposite the opening, the device can include a flat surface for printing information thereon, such as advertising logos. The section should be large enough to display readable information thereon such as the name of a golf course, a sports team, a sporting goods manufacturer or other information.

If desired, the device can include a device for attaching the elevation device to another object such as a golf bag. For example, a clip can be attached to the device which allows it to be hooked onto an existing ring on a golf bag, a belt loop, a golf cart, or other suitable location, when not in use.

DETAILED DESCRIPTION OF THE EMBODIMENTS

Figure 1:
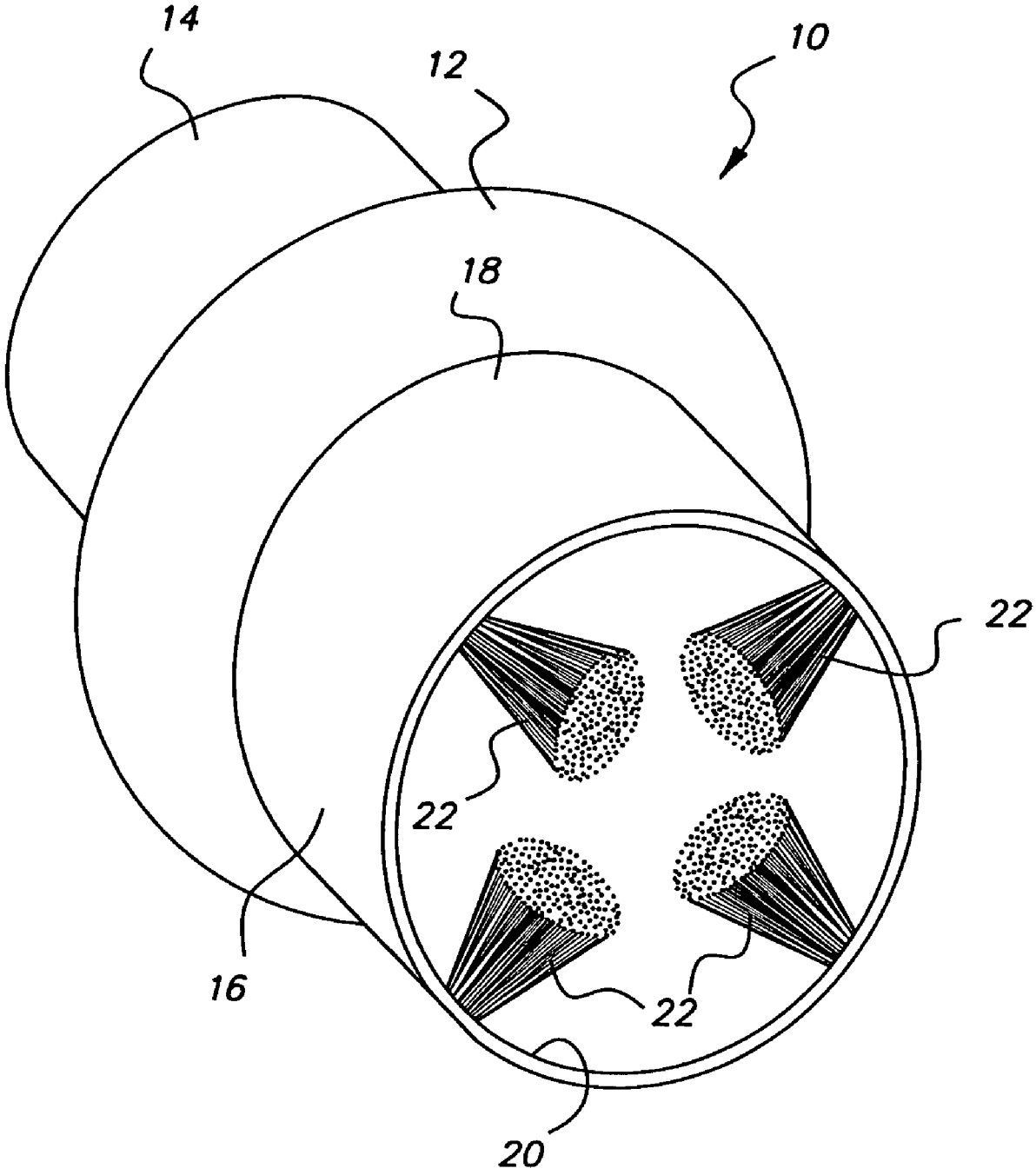
FIG. 1 is a perspective view of the golf club elevation apparatus of the present invention.

FIGS. 1-13 illustrate the present invention. FIG. 1 shows one embodiment of the golf club elevation device 10 of the present invention. The device 10 includes a contact section 12 and a grip section 14. The device 10 has, at its end 16 opposite the grip section 14, a club receiving section 18 with an open end 20 having brushes 22 therein.

Figure 2:
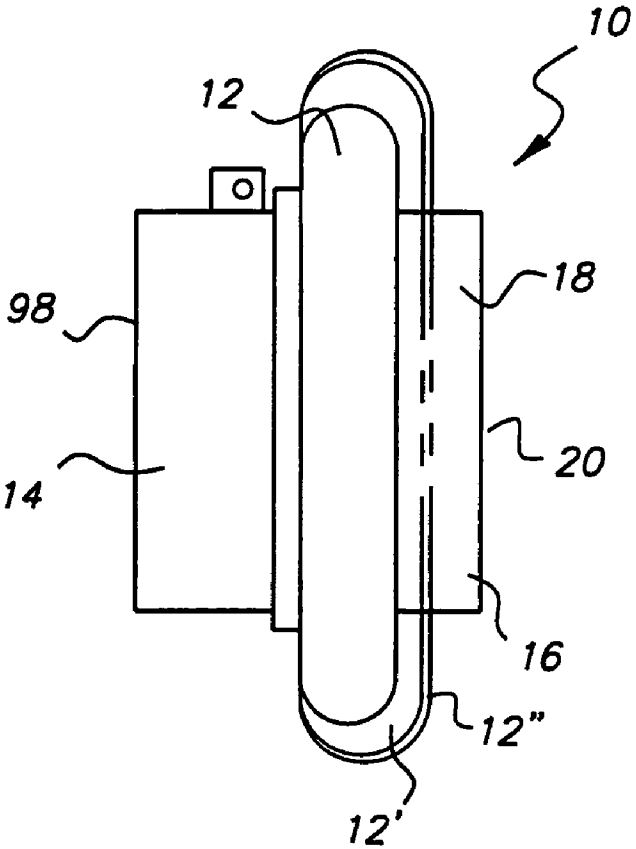
FIG. 2 is side elevation view of the invention of FIG. 1.

The contact section 12 can have various widths, shown in phantom as 12' and 12" in FIG. 2. As will be recognized by one of ordinary skill in the art, the contact section 12 can also be made in various shapes and is shown as annular for illustration purposes. Thus, the dimensions of the device 10 may be varied significantly as long as the contact section 12 is not so thin as to leave a mark on the golf course when it is placed on the ground or dropped to the ground. Preferably its thickness is greater than 0.25 inches.

Figure 3:
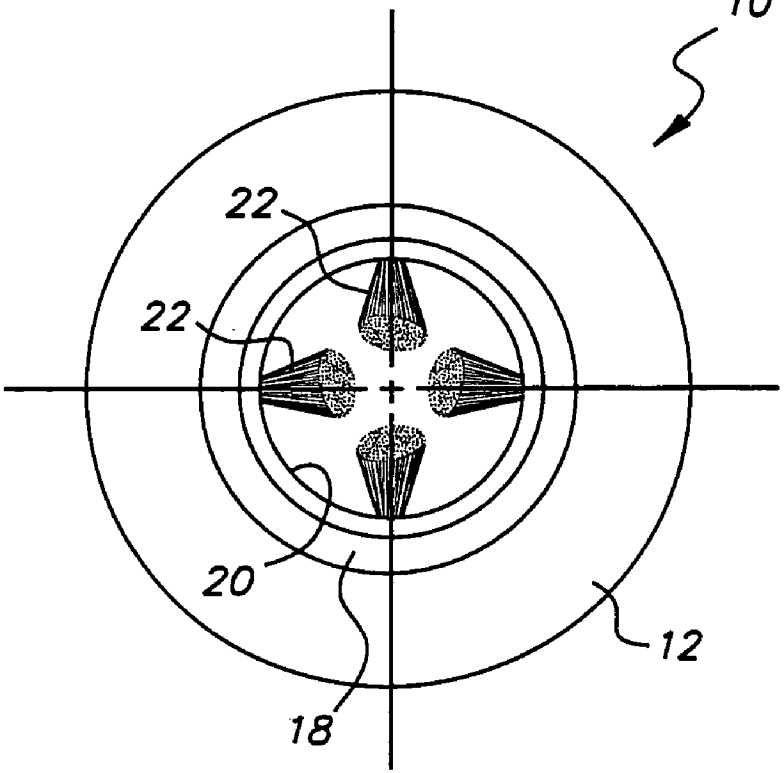
FIG. 3 is an end elevation view of the invention of FIG. 1.
Figure 4:
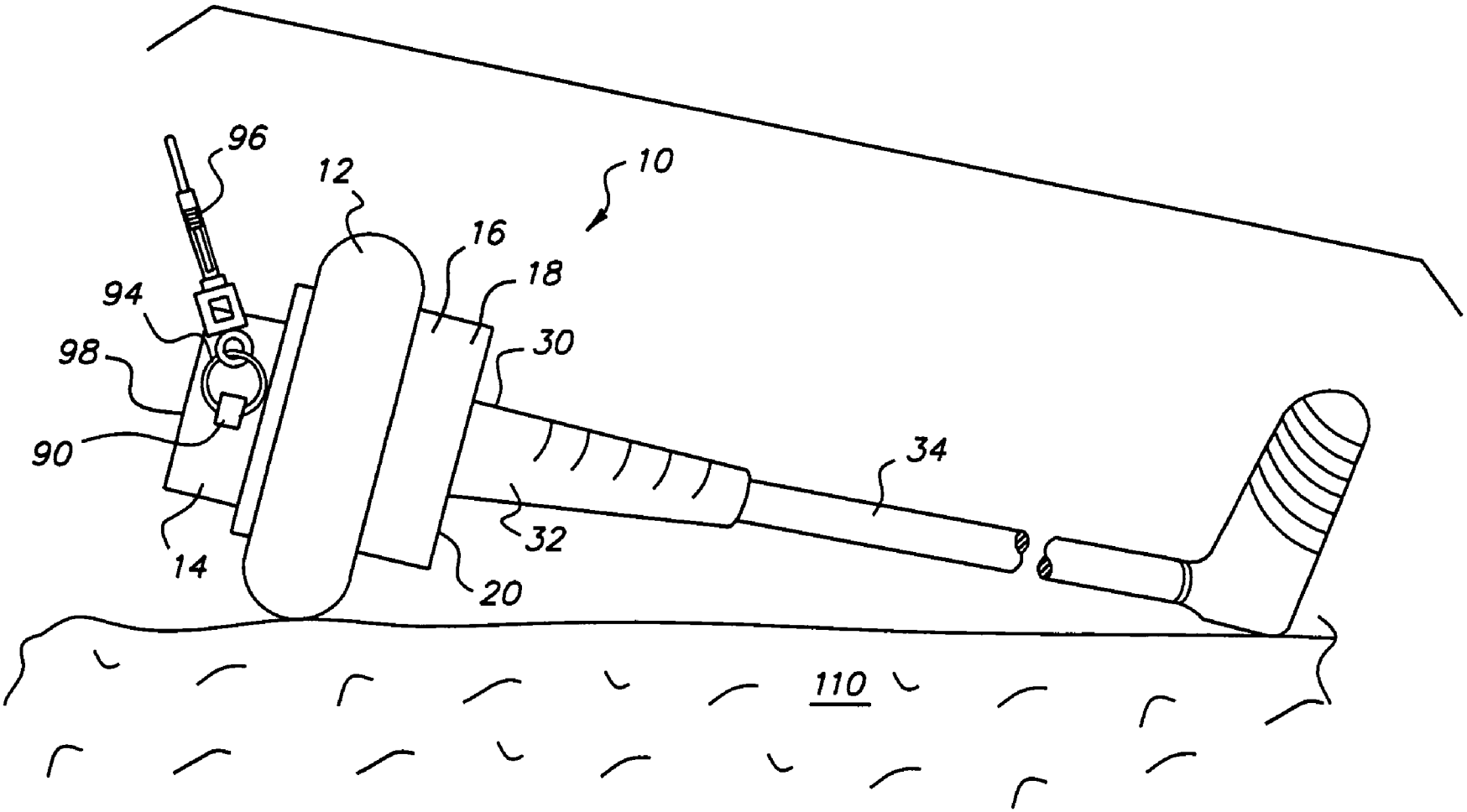
FIG. 4 is a side elevation view of the invention of FIG. 1 installed on a golf club.

As shown in FIGS. 3 and 4, the open end 20 is designed to receive the end 30 of a handgrip 32 of a golf club 34. The end 30 of the handgrip 32 fits snugly in the opening 20 and is held in place by the brushes 22.

Figure 5:
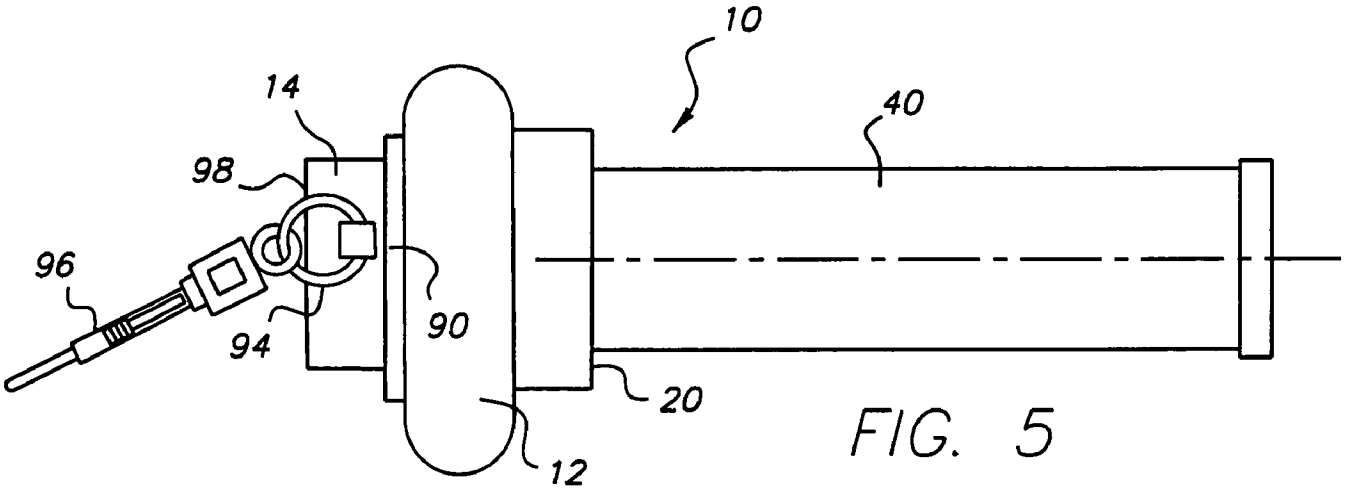
FIG. 5 is a side elevation view of a second embodiment of the golf club elevation apparatus of the present invention.
Figure 6:
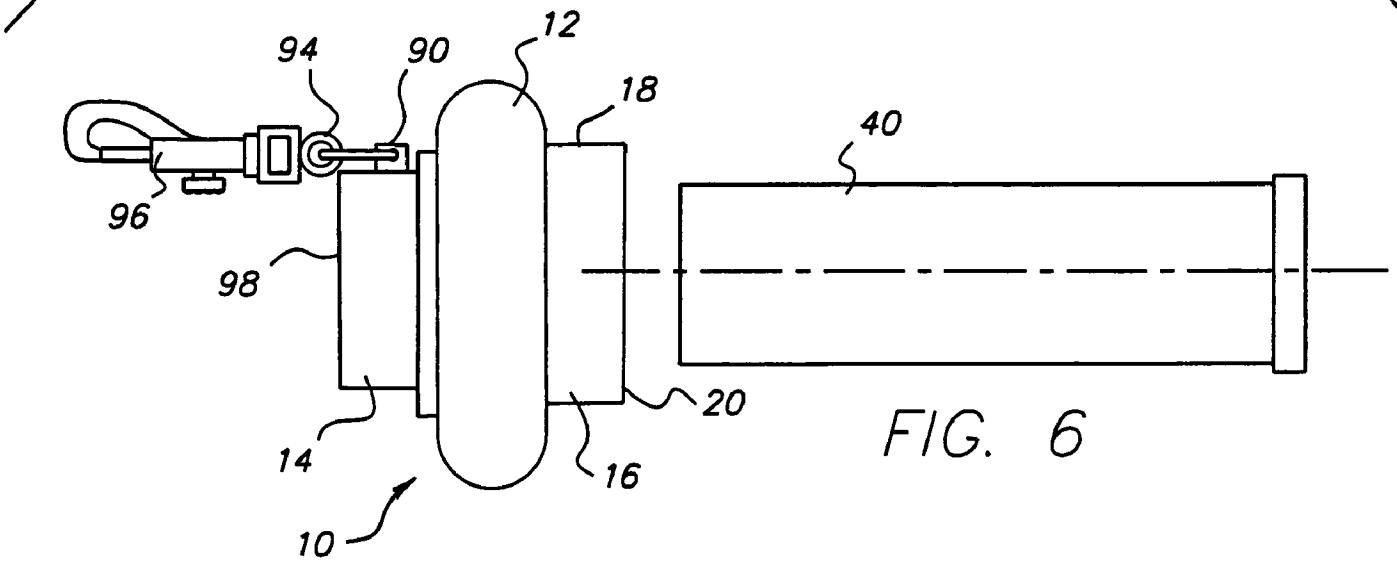
FIG. 6 is a side elevation view of a second embodiment of the golf club elevation apparatus of the present invention.

In a second embodiment, the device 10 is used in connection with a grip cover 40, as shown in FIGS. 5 and 6. The grip cover 40 is shown as cylindrical for illustration purposes, but may also be made in various shapes as long as it covers a portion of the handgrip 32. The grip cover 40 is received in the end 20 of the device 10 and is held snugly in place, through an interference fit or other suitable means.

Figure 7:
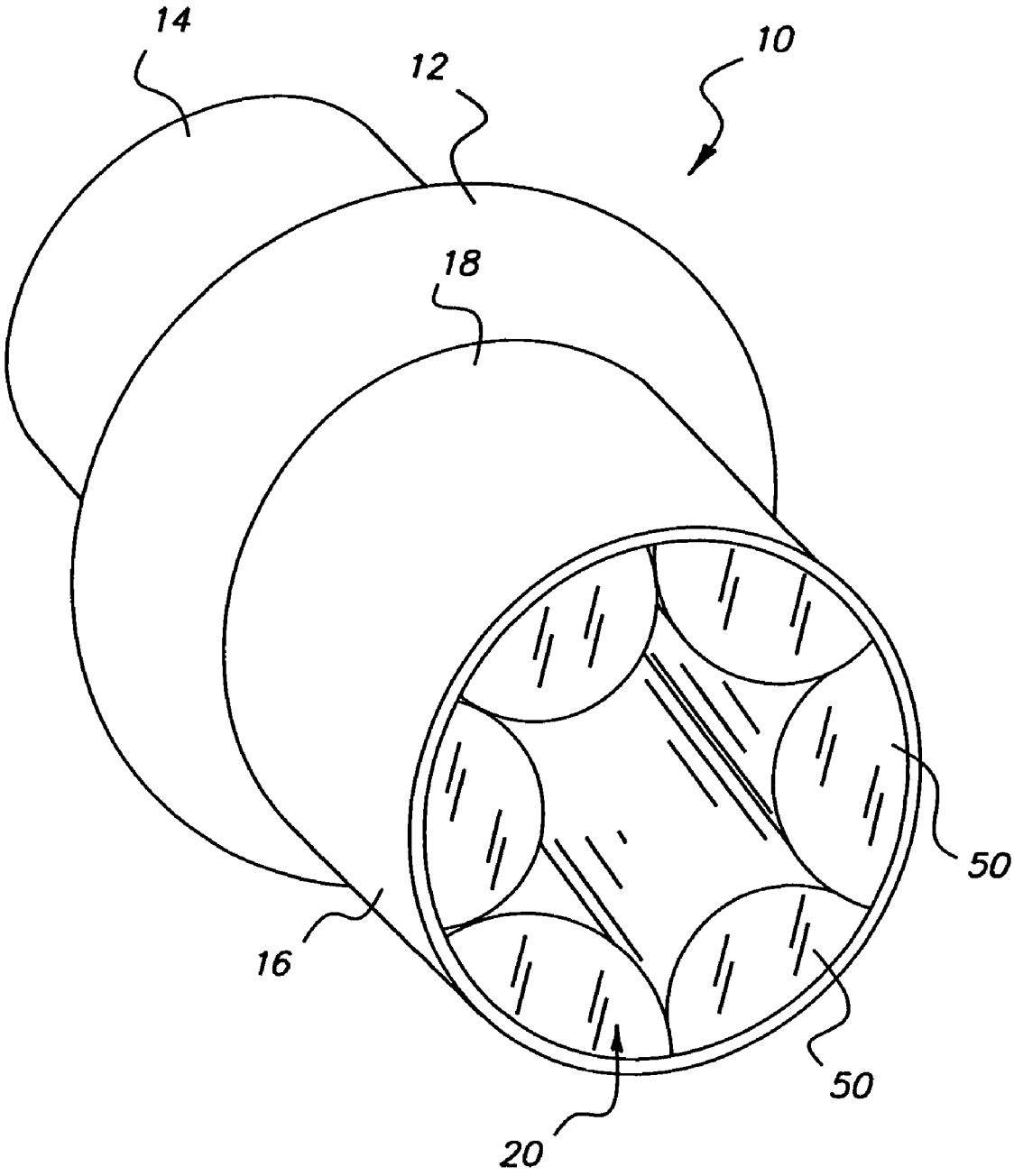
FIG. 7 is a perspective view of another embodiment of the golf club elevation apparatus of the present invention.
Figure 8:
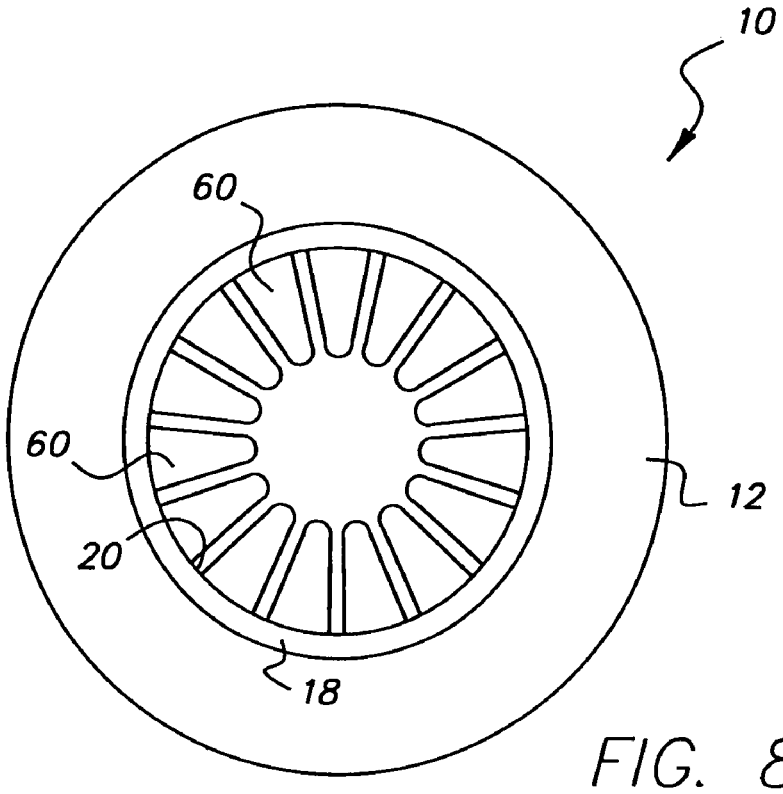
FIG. 8 is an end view of another embodiment of the golf club elevation apparatus of the present invention.
Figure 9:
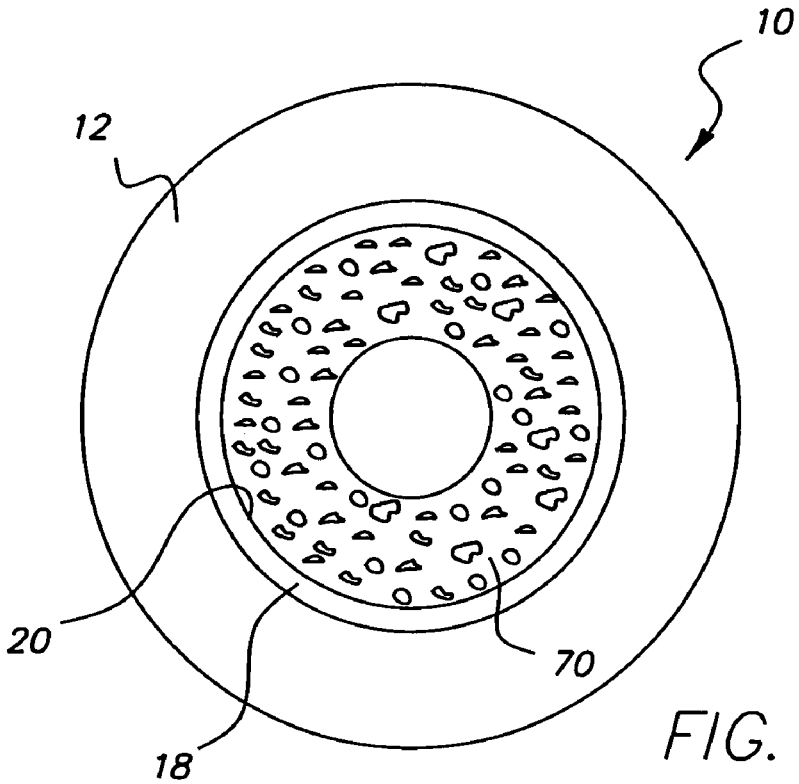
FIG. 9 is an end view of another embodiment of the golf club elevation apparatus of the present invention.
Figure 10:
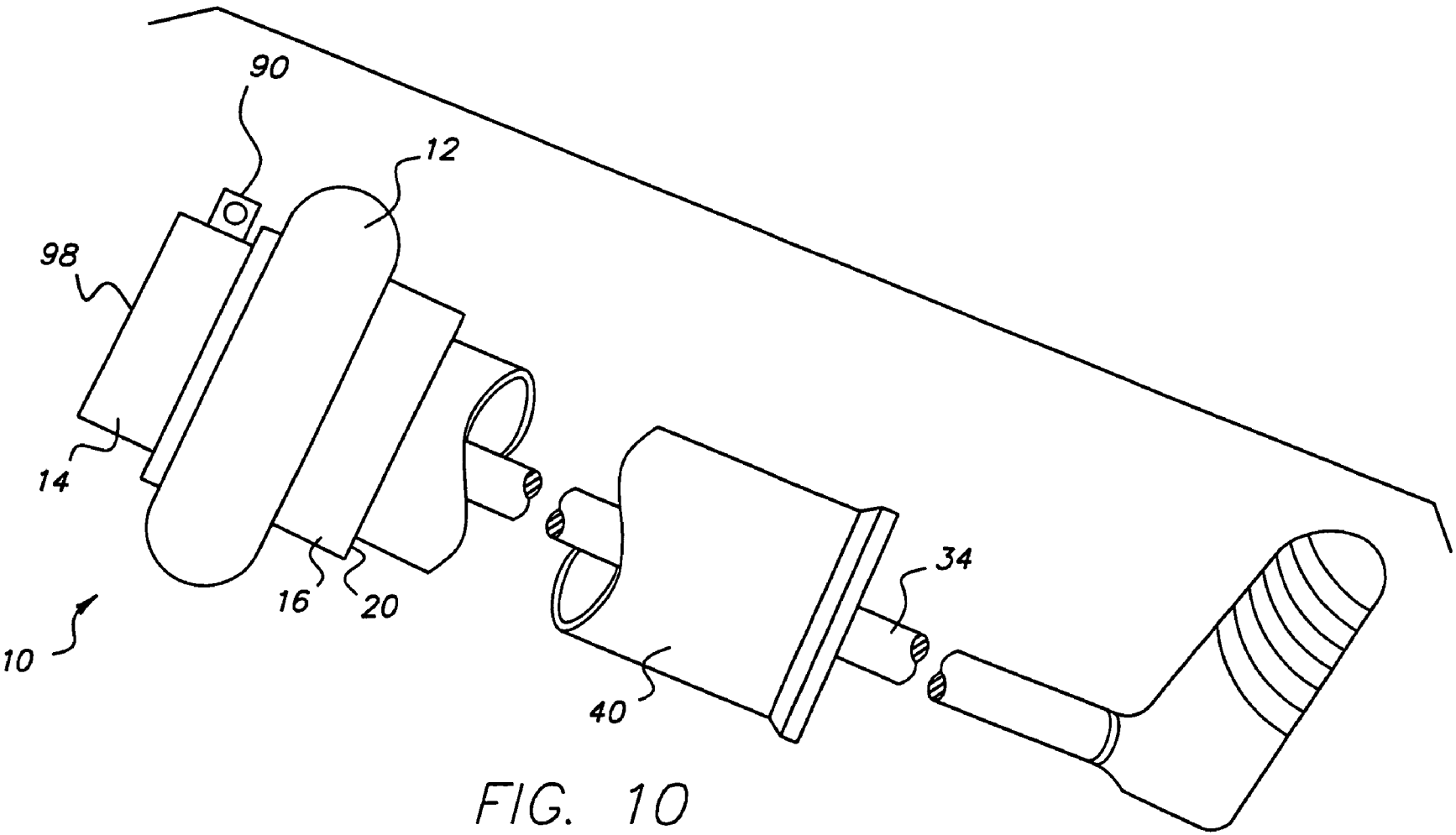
FIG. 10 is a cutaway side elevation view of the golf club elevation apparatus of the present invention installed on a golf club.

FIGS. 7-9 show alternate designs for the device 10. In FIG. 7, the brushes 22 have been replaced with flexible ribs 50. The flexible ribs are designed to deform and hold the end 30 of the handgrip 32 securely in place (FIG. 4).

FIG. 8 shows another embodiment of the device 10. In this figure, the brushes 22 have been replaced with fingers 60. The fingers 60 are designed to hold the end 30 of the handgrip 32 securely in place.

In FIG. 9, another embodiment of the device 10 is shown. In this embodiment, the brushes 22 have been replaced with a soft, flexible material 70, which deforms to snugly hold the end 30 of the handgrip 32 securely in place.

Figure 11:
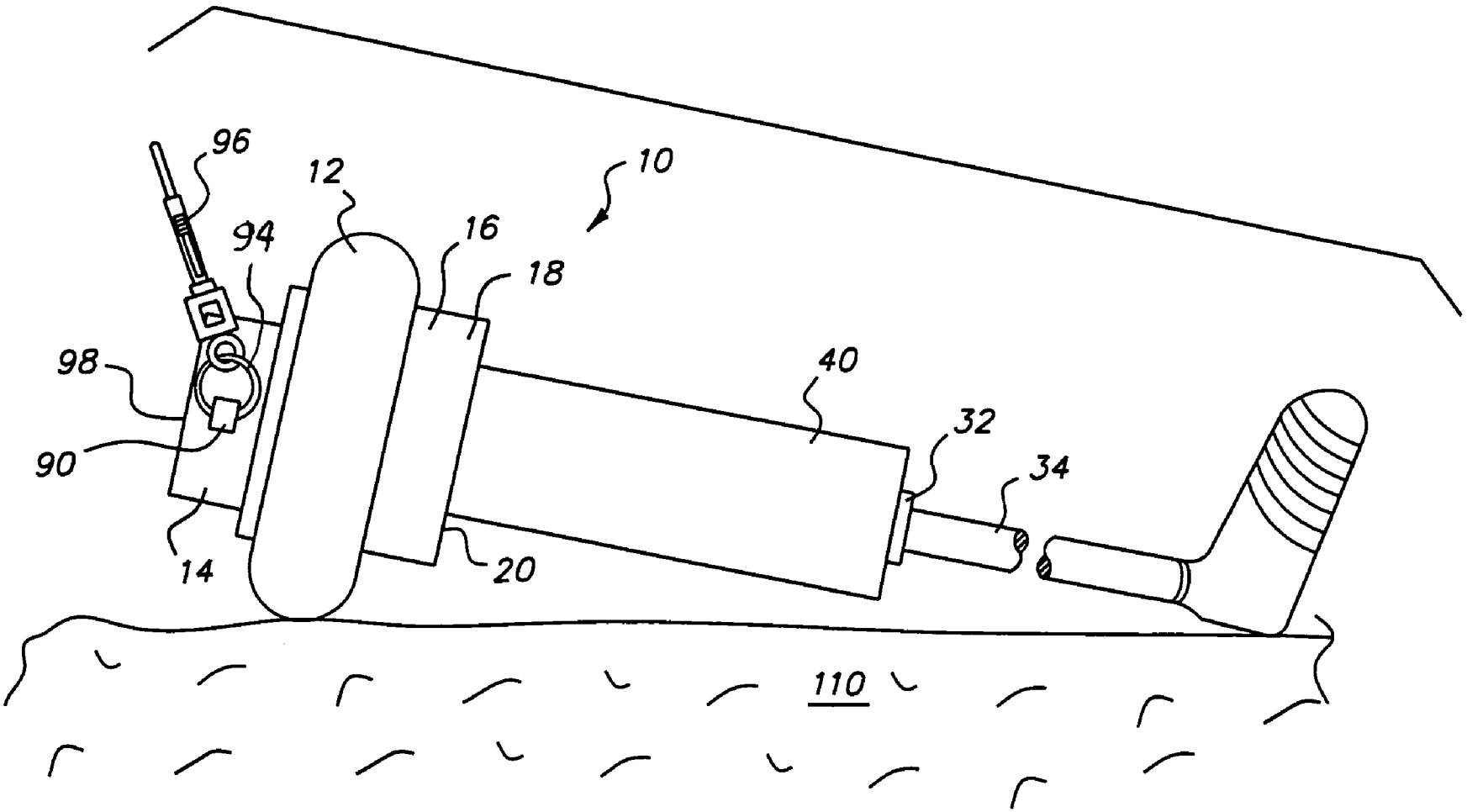
FIG. 11 is a side elevation view of the golf club elevation apparatus of the present invention installed on a golf club.
Figure 12:
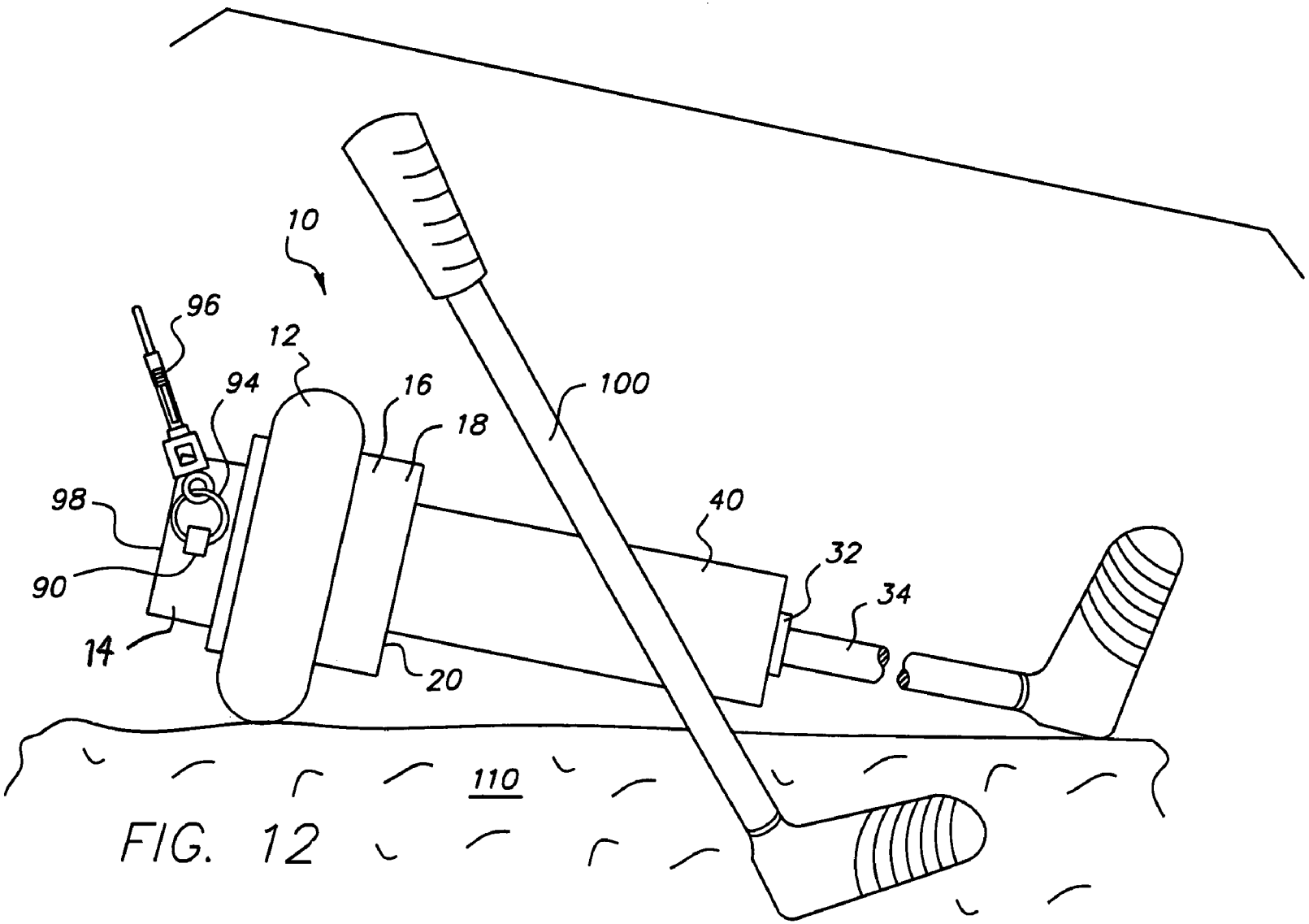
FIG. 12 is a side elevation view of the golf club elevation apparatus of the present invention installed on a golf club shown in connection with a second club.
Figure 13:
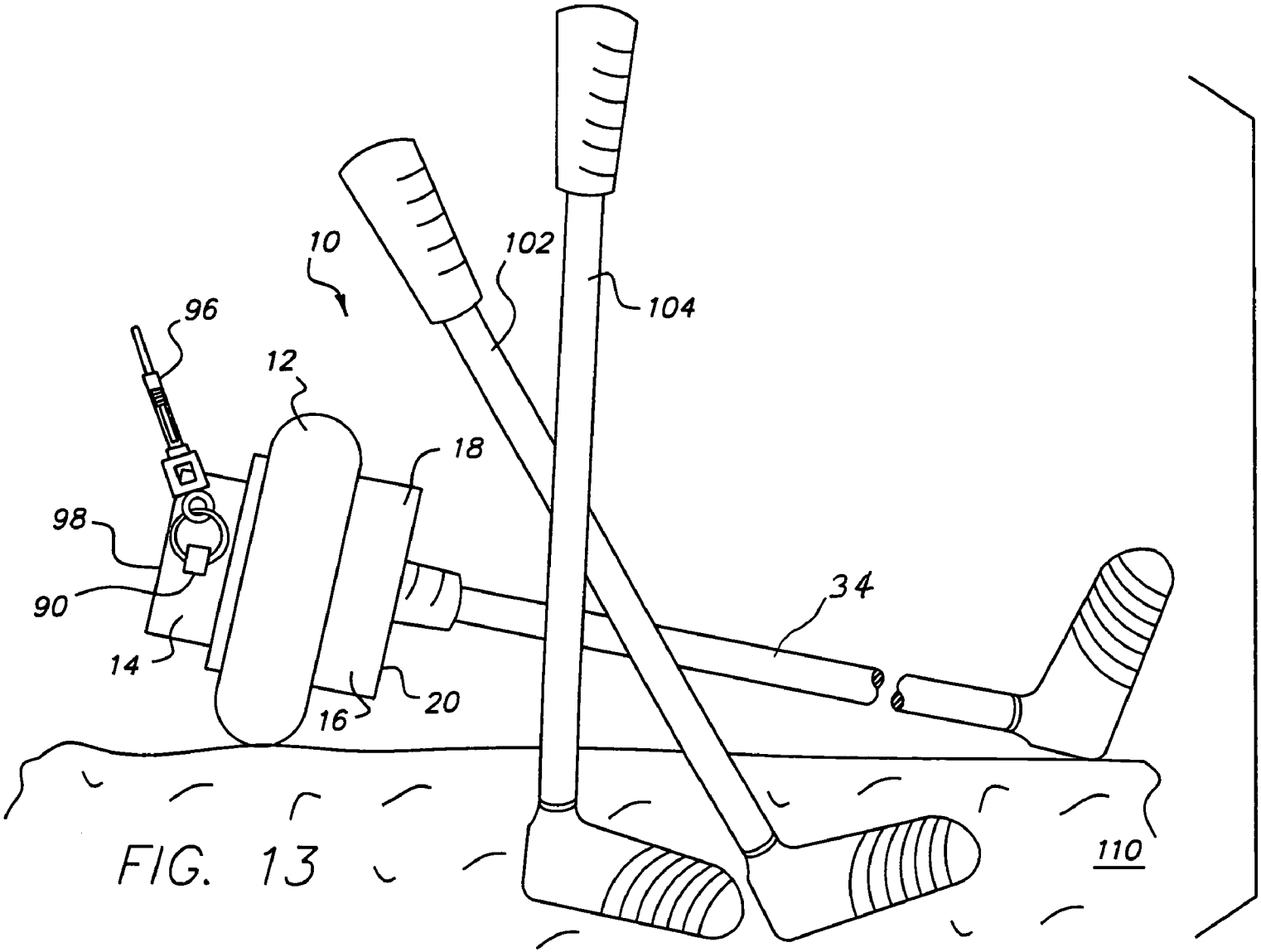
FIG. 13 is a side elevation view of the golf club elevation apparatus of the present invention installed on a golf club shown in connection with two additional clubs.

As shown in FIGS. 11-13, the device 10 may include an attachment anchor 90, a ring 94 and clip 96 such that the device 10 may be clipped onto a golf bag (not shown) when not in use. Also, the device may include a closed end 98 opposite the open end 18. The closed end 98 may be designed to allow for the printing of information, advertisements, logos or other printed text or graphics.

In use, as shown in FIGS. 4 and 10-13, the device 10 is slipped over the end 30 of the handgrip 32 of the golf club 34. The golf club 34 can then be placed on the ground with the handgrip 32 elevated off of the ground 110. The club 34 is supported at one end by the contact section 12 at the other end by the head 36 of the golf club 34. When the golfer picks up the device 10, he grips the grip section 14 which is also elevated off of the ground 110. In this manner, the golfer is able to pick up the club 34 without getting his hand wet.

As shown in FIG. 12, the device 10 is sturdy enough, such that a golfer may place it on the ground 110 and place another club 100 on top of the first club 34, such that handgrips on both clubs are held off of the ground 110. The golfer may also place two clubs 102 and 104 on top of the first club 34 (FIG. 13).

What is claimed is:

1. A golf club handgrip elevation apparatus for elevating a portion of a golf club off of the ground, the golf club having a handgrip and a longitudinal axis, the golf club handgrip elevation apparatus comprising, a receiving section having an opening in one end to receive an end of the handgrip and having a grip holder for releasably holding the golf club handgrip;

a contact ring abutting the receiving section;

a grip ring having a portion thereof spaced away from the contact ring in the direction of the longitudinal axis, the grip ring sized such that when the golf club handgrip is placed into the golf club handgrip elevation apparatus, and the contact ring is in contact with the ground at a point at which the ground is relatively level along the entire length of the golf club handgrip elevation apparatus in the direction of the longitudinal axis, the grip ring is exposed to the ground but is held above the ground such that a user is able to place his fingers between the lowermost point of the grip ring and the ground to pick up the golf club without his fingers contacting the ground wherein said contact ring is spaced entirely from both longitudinal ends of said apparatus.

2. The golf club handgrip elevation apparatus of claim 1 wherein the contact ring has a width in the longitudinal direction of greater than 0.25 inches.

3. The golf club handgrip elevation apparatus of claim 1 wherein the contact ring has a continuous outside perimeter.

4. The golf club handgrip elevation apparatus of claim 1 wherein the grip ring has a flat surface.

5. The golf club handgrip elevation apparatus of claim 4 wherein the flat surface is adapted to display printed information.

6. The golf club handgrip elevation apparatus of claim 5 wherein the flat surface has a surface area of greater than one square inch.

7. The golf club handgrip elevation apparatus of claim 5 wherein the flat surface is substantially planar.

8. The golf club handgrip elevation apparatus of claim 1 wherein the grip holder includes brushes for holding the handgrip.

9. The golf club handgrip elevation apparatus of claim 1 wherein the grip holder includes fingers for holding the handgrip.

10. The golf club handgrip elevation apparatus of claim 1 wherein the golf club handgrip elevation apparatus is constructed of a polymer material.

11. The golf club handgrip elevation apparatus of claim 1 further including an attachment device for attaching the golf club handgrip elevation apparatus to a golf bag.

12. The golf club handgrip elevation apparatus of claim 11 wherein the attachment device includes a clip.

* * * * *